United States Patent [19]

Schoofs

[11] 4,455,796

[45] Jun. 26, 1984

[54] INSULATING GLASS UNIT AND SPACER BAR THEREFOR

[75] Inventor: Richard J. Schoofs, Moraga, Calif.

[73] Assignee: Schoofs Incorporated, Moraga, Calif.

[21] Appl. No.: 492,208

[22] Filed: May 6, 1983

Related U.S. Application Data

[63] Continuation of Ser. No. 194,752, Oct. 7, 1980.

[51] Int. Cl.[3] ..... E06B 7/12

[52] U.S. Cl. ..... 52/172; 52/304; 52/790

[58] Field of Search ..... 52/172, 788, 789, 790, 52/304

[56] References Cited

U.S. PATENT DOCUMENTS

| | | | |
|---|---|---|---|
| 2,419,400 | 4/1947 | Haven | 52/172 |
| 2,838,809 | 6/1958 | Zeolla | 52/172 |
| 4,222,209 | 9/1980 | Peterson | 52/172 |
| 4,222,213 | 9/1980 | Kessler | 52/172 |
| 4,232,492 | 11/1980 | Remick | 52/172 |
| 4,296,587 | 10/1981 | Berdan | 52/788 |

FOREIGN PATENT DOCUMENTS

| | | | |
|---|---|---|---|
| 605245 | 7/1948 | United Kingdom | 52/304 |
| 918650 | 2/1963 | United Kingdom | 52/172 |

OTHER PUBLICATIONS

The Condensed Chemical Dictionary, (Tenth Edition), ©1981, Litton Educational Publishing Inc.

*Primary Examiner*—Henry E. Raduazo

*Attorney, Agent, or Firm*—Limbach, Limbach & Sutton

[57] ABSTRACT

A novel spacer bar for an insulating glass unit and an insulating glass unit filled with the spacer bar are disclosed. Deflection of the panes of the insulating glass unit, however caused, is essentially eliminated by the functioning of the spacer bar. The spacer bar is so constructed that a protion of its surface in contact with the space between the panes (inner surface) is perforated and a portion is imperforate and the opposite surface of the spacer bar has a small opening in its surface, which opening is opposite the imperforate portion of the inner surface. Means to place the small opening in communication with the exterior atmosphere is provided.

5 Claims, 3 Drawing Figures

INSULATING GLASS UNIT AND SPACER BAR THEREFOR

This is a continuation of Application Ser. No. 194,752, filed Oct. 7, 1980.

This invention relates to insulating glass units which are essentially free of glass deflection, and to unique spacer bars for use in such insulating glass units.

BACKGROUND OF THE INVENTION

Insulating glass units generally consist of two or more parallel panes of glass which are spaced apart from each other and which have the space between the panes sealed along the peripheries of the panes to enclose an air space between them. The most commonly used insulating glass units are double glazed windows. A double glazed window consists of two usually rectangular panes of glass which are placed in congruent relationship. Spacer bars are placed along the periphery of the space between the two panes. The spacer bars are long, hollow prisms having cross sections which are generally shaped in the form of isosceles trapezoids. The peripheries of the two panes and the spacer bars lying between them are sealed with a sealing composition so that the air space enclosed between the panes is sealed from contact with the outside atmosphere. The surfaces of the spacer bars facing the interior of the enclosed air space are perforated or slotted and the spacer bars themselves are filled with a solid adsorbent capable of taking up water vapor and organic materials which may be present in the enclosed air space when the unit is sealed with an organic sealant or which may enter the enclosed air space by diffusion from the sealant after sealing. Air enclosed in the space between the panes diffuses through the slots or perforations in the spacer bars and contacts the adsorbent in the interior of the spacer bars with the result that water vapor and any solvent or organic material getting into the enclosed air space from the sealing compound are adsorbed on the adsorbent employed. The result is that cooling of the interior air does not cause deposition of water vapor or organic material on the interior surfaces of the panes.

Insulating glass units of this design are frequently subjected to deflection of the glass panes due to pressure changes when the temperature of the outside air changes, adsorption or desorption of nitrogen or other gases on or from the adsorbent, and changes in atmospheric pressure. When the pressure of the air in the space enclosed between the panes becomes less than the exterior pressure, the panes are forced closer together. When the pressure in the space between the panes is greater than the exterior pressure the panes are forced apart. Since the peripheries of the panes are held in pretty much fixed position by the sealant deflection is observed to occur in the area of the glass lying inside the peripheries of the panes.

Deflection gives rise to several problems which must be faced by the manufacturer and/or the user of the insulated glass units. When appreciable deflection occurs the reflected images from the windows are distorted and present an undesirable cosmetic effect. This effect is not functionally serious but users of the insulating glass units object to the distorted reflections. Deflection which results in the movement of the two panes of glass closer together or farther apart when the exterior pressure is greater or less than the pressure of the enclosed air space between the panes places stress on the sealing compounds which lie along the periphery of the insulating glass unit and gradually weaken the seals so that leakage of the relatively moist exterior air into the enclosed space occurs with the result that the capacity of the adsorbent in the spacer bars is exhausted and condensation of moisture at low temperature begins to appear in the windows. Deflection which results when the panes are forced closer together decreases the insulating properties of the unit since these properties are a function of the width of the air space between the panes. If the panes are forced into contact with each other insulating properties are lost. Serious deflection can also cause cracking and even breakage of the windows particularly along the peripheries of the panes.

The deflection problem has been recognized and steps have been taken to reduce the amount of deflection experienced during transportation or use of the insulating glass units.

For example, it has been recognized that pressure problems arise when insulating glass units are shipped from a point of manufacture to a point of use and the altitudes between the two points are substantially different. In these situations it has been common practice to insert a small open tube, commonly known as a "breather tube", into the side of the spacer bar facing the exterior of the insulating glass unit. The breather tube permits flow of air between the interior of the insulating glass unit and the ambient atmosphere and thereby equilibrates the pressure. Typically, the breather tube is sealed immediately after the unit is transported to the altitude at which it is to be installed.

More recently it has been found that if the diameter of the breather tube is sufficiently small (of the order of 0.01 inch) and sufficiently long (generally of the order of at least one foot or more) entry of outside air into the insulating glass unit by simple diffusion is minimized and the insulating glass unit will exhibit sufficiently long life even if a breather tube of these dimensions is not sealed. It should be noted that breather tubes of this kind generally enter the side of the spacer bar facing the exterior of the insulating glass unit, and gas flow as air is "inhaled" into the air space enclosed between the panes of the unit is through the breather tube, through a small segment of the spacer bar and a small segment of the adsorbent contained in it with the flow of gas essentially perpendicular to the length of the spacer bar, then through the crack or slot or perforations in the spacer bar into the air space enclosed between the panes of the unit. During "exhaling" the gas flow is in the reverse direction.

Only recently it has been recognized that a serious cause of deflection in insulating glass units is the fact that the adsorbents with which the spacer bars have been filled adsorb nitrogen when the temperature in the interior of the space between the panes is low and desorb nitrogen when the temperature of the space between the panes is high. Deflection caused by nitrogen adsorption and desorption as temperature changes has been substantially eliminated by using adsorbents to fill the spacer bars which are incapable of adsorbing nitrogen but which do adsorb water vapor. This reduction of the nitrogen adsorption problem as relating to deflection is described in U.S. Pat. No. 4,144,196.

BRIEF DESCRIPTION OF THE INVENTION

It has now been found that deflection of the panes of insulating glass units, however caused, may be substantially eliminated by employing a spacer bar so constructed that a portion of its surface which is in contact wirh the space between the panes (inner surface) is perforated or slotted and the remainder of the interior surface is imperforate and the opposite surface of the spacer bar has a small opening in its surface, which opening is opposite the imperforate portion of the inner surface. The small opening is in communication with the exterior atmosphere.

THE DRAWINGS

FIG. 1 of the drawings is an offset view of a double glazed window.

FIG. 2 of the drawings is a cutaway of a corner of a double glazed window, showing the construction of the window and of the spacer bar.

FIG. 3 shows another and preferred embodiment of the spacer bar of the invention.

DETAILED DESCRIPTION OF THE INVENTION

Figure 1:
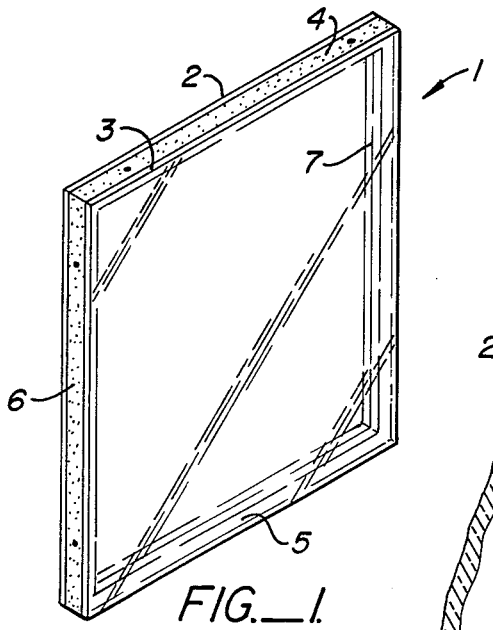

FIG. 1 of the appended drawings shows a double glazed window generally indicated by the numeral 1. Outside glass pane 2 and inside glass pane 3 are rectangular sheets of glass and are placed in congruent relationship. Top spacer bar 4, bottom spacer bar 5, left-hand spacer bar 6 and right-hand spacer bar 7 lie between the peripheries of the two panes. The spacer bars and the panes are held together in the position shown by sealant 11 shown in FIG. 2. The sealant is typically a material such as a polysulphide resin or polyolefin resin. Spacer bars 4, 5 and 6 are conventional spacer bars and spacer bar 7 is the spacer bar of the invention which is shown in greater detail in FIG. 2. At least one of the two vertical spacer bars 6 and 7 is filled with a solid adsorbent having a high capacity for adsorption of water vapor. Suitable adsorbents are molecular sieve zeolites, alumina, and silica gel. In a preferred embodiment of the invention top spacer bar 4 is filled with a molecular sieve zeolite, such as 13X zeolite. The vertical spacer bars are filled with either a mixture of silica gel or alumina with a molecular sieve zeolite, preferably zeolite 3A or they may be filled with either silica gel or alumina. Space bar 7 is preferably filled with silica gel or alumina. Bottom spacer bar 5 may be left empty or it may be filled with adsorbent. In the preferred embodiment of the invention top spacer bar 4 and/or bottom spacer bar 5 are filled with adsorbent. Activated alumina, silica gel or molecular sieve zeolites or mixtures thereof or one or more of the aforementioned adsorbents in admixture with activated carbon are suitable adsorbents, but zeolites are the preferred adsorbent. In insulating glass units in which hydrocarbon vapors may be present or are likely to be released from the sealing composition, at least a portion of the adsorbent in the spacer bars, preferably 4 and/or 5 should have an average pore diameter which permits entry of benzene into the pore space so that solvent and hydrocarbon vapors will be adsorbed.

Figure 2:
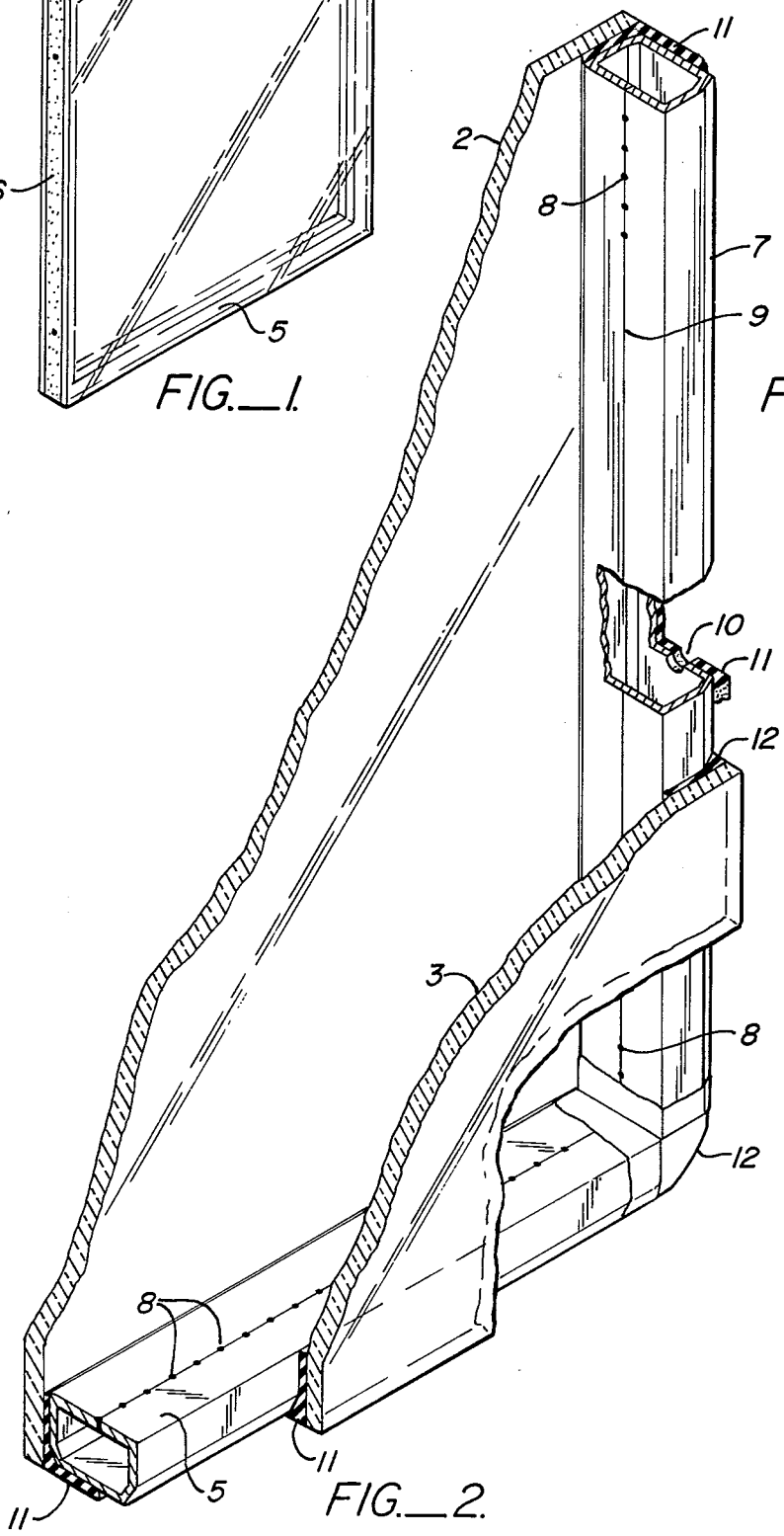

FIG. 2 of the drawings is a cutaway showing in detail the lower right corner of the double glazed window of FIG. 1. Panes 2 and 3 are the outer and inner panes of glass, respectively. Spacer bar 7 shows details of the improved spacer bar of the invention. Spacer bars are conventionally made by roll forming a long, narrow strip of metal usually aluminum. In the roll forming process the outer edges of the narrow strip are brought together to form the surface of the spacer bar which is in contact with the interior air space enclosed between the panes. Line 9 shows the junction of these two edges. The outer edges of the metal strip subjected to the rolling process may be roughened so that when the two edges are brought together there is a small, narrow space between them which is small enough in width to prevent the adsorbent with which the bar is filled from passing through the narrow opening but the opening is large enough to permit diffusion of air, water vapor and organic material escaping from the sealant contained in the space between the panes through the narrow opening and into contact with the adsorbent filling the spacer bar. Perforations or slot like openings between the edges of the spacer bar are indicated by the numeral 8. The portion of the spacer bar lying between the lowest of the perforations at the upper end of the spacer bar and the highest of the perforations at the lower end of the spacer bar is sealed either with a sealant or by soldering so that this segment of the spacer bar will not permit passage of air through it either into or out of the enclosed air space. Opening 10 is a small opening through the sealant and the surface of the spacer bar which faces the outer atmosphere and is located at or near the midpoint of the sealed segment of the bar. This opening normally ranges from about one hundredth to one tenth inch in effective diameter so that air under small pressure will pass through it in either direction but so small that no appreciable diffusion of air through the opening will occur when there is no pressure differential between the enclosed air space and the outer atmosphere. Opening 10 should be small enough to prevent passage of the adsorbent particles through it. The cross section of the spacer bar is somewhat in the form of an isosceles trapezoid. This shape is used so that there will be a small space between the panes of glass and the sides of the spacer bar adjacent the peripheries of the panes which is generally triangular in cross section and which permits the sealing composition to enter this space and seal the spacer bar to the pane. Elbow member 12, commonly referred to as a corner lock, is so shaped so that the arms of the elbow conform in cross section to the cross section of the spacer bar but the dimensions are slightly smaller so that each arm of the elbow will penetrate the end of a spacer bar at the corner. The purpose of the corner lock is to connect the spacer bars to form a peripheral metal rectangle and to hold adsorbent in place.

Corner locks are commonly made from solid organic polymers such as polyethylene, nylon and the like or from metal, usually zinc. The arms of the corner lock must fit tightly against the inner surfaces of the spacer bar to prevent leakage. A sealant may be applied to the junction of the corner lock arm and the interior of the spacer bar to ensure air-tight closure. Corner locks are usually solid but may be hollowed to provide a path of communication between the adsorbent masses in the spacer bars which meet at a corner if desired.

If spacer bar 7 were constructed as shown and described above, except that the bar was perforated throughout its whole length instead of having an imperforate segment lying above and below opening 10, then when the pressure inside the enclosed air space is lower than the outer air pressure, air will flow through opening 10 and take the path of least resistance directly through the adsorbent and through the perforations in the spacer bar into the space between the panes. This flow path would be essentially perpendicular to the length of the spacer bar and only a narrow band of the adsorbent would be contacted by the air entering the space between the panes. When the spacer bar is constructed as shown in FIG. 2, air flowing through opening 10 from the atmosphere into the spacer bar must travel a path parallel to the length of the spacer bar upwardly and downwardly through the mass of adsorbent until it rises and lowers to a point where it comes into contact with perforations 8 at which time it is able to pass through the spacer bar into the space between the panes. This path of air travel brings it into contact with a large mass of adsorbent before it enters the space between the panes. Moisture in the air traversing the mass of adsorbent lying between opening 10 and the upper and lower perforations is completely adsorbed. During daylight hours the window is exposed to direct contact with relatively warm outside air the air enclosed in the space between the panes is warmed and expands. The interior pressure then exceeds the pressure of the outside atmosphere and gas flow is from the interior of the window out into the atmosphere. In order for the gas to make its way from the interior of the window out it must pass through the perforations 8 above and below opening 10 and then pass through the mass of adsorbent lying between the perforations 8 and the opening 10. The warm air contacts the adsorbent which had previously picked up moisture from entering air and desorbs the moisture so picked up. The net result is that when the window "inhales" moisture is picked up by the adsorbent and when it "exhales" moisture is desorbed from the adsorbent so that the net pickup of moisture by the adsorbent after many cycles of inhaling and exhaling is very, very small.

Figure 3:
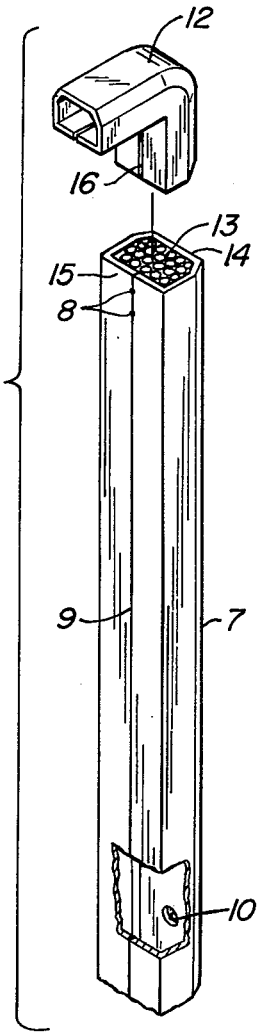

FIG. 3 of the appended drawings shows an alternative and desired structure for the spacer bar of the invention. The spacer bar 7 is a hollow prism. Its cross section is generally of the form of an isosceles trapezoid having the longer base 15 of the trapezoid facing the interior of the space between the panes of the window and the shorter base 14 of the trapezoid facing the exterior atmosphere. The prism is filled with a solid adsorbent 13 as above described. The surface of the spacer bar facing the space between the panes is entirely closed from bottom almost to the top. At the top of the spacer bar communication between the interior of the spacer bar and the space between the panes is through perforations 8 which may simply be an unsealed portion of the junction 9 of the edges of the metal strip from which the spacer bar is conventionally roll formed. Alternatively, communication may be via slots 16 in the arm of the corner key which fits into the upper open end of the spacer bar or via both perforations 8 and slot 16. Small opening 10 through the sealant and the outer surface of the spacer bar is placed at the bottom of the spacer bar so that the opening lies just above upper surface of any corner lock which is inserted in the bottom of the bar. When the pressure of the outside atmosphere exceeds that of the space between the panes of the window air flows from the outer atmosphere through opening 10 and then passes through the entire column of adsorbent and escapes into the space between the panes through perforations 8 or slot 16 at the top of the bar. Corner lock 12, an arm of which fits into the spacer bar is shown in exploded position above. Instead of placing perforations on the inner face of the bar at its upper end, the entire inner face may be closed and slot 16 may be cut in the inner face of the lower arm of the corner lock to permit air to flow into or out of the space between the panes through the slot. This embodiment of the spacer bar may be formed by extrusion rather than by roll forming if desired. If formed by extrusion, then perforations 8 may be drilled through the upper interior surface of the spacer bar if desired or alternatively, slots in the face of the corner lock may provide the entire route for air to travel into the space between the panes or out of it. In the event that the spacer bar is made by roll forming then the rectangular metal sheet from which the bar is formed may be so rolled that the junction 9 of the edges of the sheet does not lie on the surface of the bar which is to face the space between the panes but lies instead on one of its other surfaces. Perforations then may be drilled at the top of the inner surface of the bar or slots 16 in the arm of corner lock 12 may be used to provide communication between the interior of the bar and the space between the panes.

Insulating glass units employing the spacer bar as described above permit continuous equalization of the pressure of the air lying in the space enclosed between the panes and the outer atmospheric pressure. When the pressure in the space between the panes becomes lower than the exterior atmosphere pressure then air flows from the atmosphere through the spacer bar into the space between the panes. Conversely, when the pressure of the air enclosed in the space between the panes exceeds that of the exterior atmospheric pressure, then air flows from the space between the panes to the exterior atmosphere. When air is flowing from the atmosphere into the space between the panes the arrangement of the spacer bar requires the air to traverse a long segment of the spacer bar filled with adsorbent before reaching a perforation in the spacer bar or a slot in the corner lock which permits the inflowing air to pass into the space between the panes. Conversely, when the pressure in the space in the panes exceeds that of the interior atmosphere then air flows from the space between the panes to the atmosphere and the flow path requires it to traverse a mass of adsorbent lying between the top of the spacer bar and the small opening 10 through which the outflowing air can pass into the atmosphere. During inflow all of the moisture contained in the entering air is adsorbed on the solid adsorbent particles filling the spacer bar. When the air flow path is from the space between the panes to the outer atmosphere the air moving outward enters the perforations in the spacer bar or the slots in the corner lock and then must traverse a mass of solid adsorbent before reaching opening 10 which permits it to escape into the atmosphere. The outflowing air contacts the solid adsorbent which had previously been exposed to moist entering air and desorbs moisture from the adsorbent. The most frequent cause of outflow of air from the space between the panes is expansion due to heating of that air by exposure to higher outer ambient temperature during daylight hours. This heating provides contact of warmed air with the solid adsorbent and assists in the desorption of moisture from the adsorbent. The desorption of adsorbed water which attends the outflow of air from the space between the panes when the spacer bar of the present invention is employed makes it possible to obtain long window life using less expensive silica gel or activated alumina as the adsorbents. They have all the capacity required to take up moisture from the air and the fact that during the flow of air from the interior of the space between the panes to the outside atmosphere desorption of moisture occurs extends the useful life of these materials and makes them competitive with the more expensive zeolites widely used at the present time.

Since a sealant coating is applied to the peripheries of the glass panes and the outer surface of the spacer bar, small opening 10 should be plugged during application of the sealant to prevent closure of opening 10 by the sealant and the plug removed when application of the sealant is completed. Alternatively, small opening 10 may be fitted with a short cylindrical tube which extends beyond the sealant coat to ensure that communicating means between the outside atmosphere and the interior of the spacer tube will exist.

The spacer bars of the invention should preferably be in a vertical rather than a horizontal position in the finished and installed insulating glass unit. This ensures better and more uniform contacting between the adsorbent and the air which flows into or out of the insulating glass unit. If the imperforate spacer bar is in a horizontal position, any settling of the adsorbent particles will result in a non-uniform distribution of the adsorbent particles with respect to the cross section of the spacer bar and a tendency to form an adsorbent-free space across the top of the channel. Under these conditions when the window inhales or exhales, the air flows along the path of least resistance which would be along the adsorbent-free space at the top of the spacer bar. Contact between the air and the adsorbent would thereby be reduced and the performance of the adsorbent would be diminished. Suitable steps can be taken, such as careful packing of the adsorbent in the spacer bar, so that horizontal imperforate spacer bars will yield favorable results, but these steps generally require extra effort and expense.

Small diameter breather tubes have been shown to minimize water vapor entry into an insulating glass unit, since small diameter tubes tend to be a better diffusion barrier than large diameter tubes. Breather tubes can be connected to the exterior opening of the spacer bar of the present design as a diffusion barrier. This can be particularly helpful in minimizing the possible entry of liquid water such as that which might condense on the metal surfaces of the insulating glass unit.

Maximizing the length of the imperforate segment of the spacer bar(s) is desirable to maximize the performance of the adsorbent and the life of the window. The imperforate zone need not be limited to a spacer bar along one side. If the spacer bars are properly filled and connected at the corners by suitable air-tight means such as welding or a tightly fitting hollow corner lock, the imperforate segment can comprise two or more of the spacer bars contained in an insulating glass unit. It is necessary only to provide a suitable impervious barrier(s) within the spacer bar(s) or corner key(s) to ensure that the air flow does not bypass any of the adsorbent-filled imperforate segment.

The improved spacer bars described above find use in insulating glass units which comprise more than two panes of glass with the panes separated along the periphery by spacer bars and the entire unit sealed along the periphery with a sealing compound. This results in two or more enclosed air spaces. In some designs small holes in the interior panes provide communication between the otherwise separate air spaces. Adsorbent in the spacer bars functions as described above. In multiple glazed unit without interconnecting holes, separate adsorbent-filled, imperforate spacer bars as described above would be employed for each of the air spaces.

When zeolite adsorbents are used to fill the spacer bars of the invention it is desirable to employ zeolite 3A as the adsorbent. Inhaling and exhaling of the window over a long period has a tendency to produce an increase in oxygen content in the space between the panes if an adsorbent which adsorbs nitrogen is used in the spacer bar.

I claim:

1. In a double glazed window comprising two panes of glass in congruent relationship defining an internal air filled space and generally hortizontal and generally vertical spacer bars enclosing said air space, each spacer bar having two opposing planar surfaces, one surface facing said enclosed air filled space, and the other surface facing the ambient atmosphere, the improvement which comprises employing as at least one of the generally vertical spacer bars a spacer bar filled with an adsorbent capable of adsorbing water vapor at or below a selected ambient temperature and of giving off the adsorbed water at ambient temperatures above the selected temperature, said at least one spacer bar being provided with opening(s) at one end of the planar surface facing the enclosed air filled space and having a small opening in the other planar surface facing toward the atmosphere, said small opening being so placed that the openings in the two planar surfaces are at opposite ends of the spacer bar whereby, during daily and seasonal variations in the temperature of the ambient atmosphere the pane exposed to the ambient atmosphere is alternately heated and cooled with resultant heating and cooling of the enclosed air filled space, water vapor is adsorbed when the temperature in the enclosed air filled space drops and air from the ambient atmosphere flows through the solid adsorbent into the enclosed space, and water vapor is desorbed when air in the enclosed space is heated and the heated air flows from the enclosed space through the solid adsorbent into the atmosphere.

2. The improvement defined in claim 1 wherein at least one generally horizontal spacer bar is filled with an adsorbent having average pore diameters which permit the entry of benzene into the pore space and providing openings in the planar surface of said bar facing said enclosed air space.

3. The improvement defined in claim 1 wherein the opening in the planar surface of the spacer bar facing toward the atmosphere is connected to a breather tube whose diameter is generally less than about 0.05 inches and which effects free communication of air between said opening in the spacer bar and the atmosphere.

4. In a rectangular double glazed window comprising two panes of glass in congruent relationship defining an internal air space and two horizontal and two vertical spacer bars enclosing said air space, each spacer bar having two opposing planar surfaces, one surface facing said enclosed air space, and the other surface facing the ambient atmosphere, the improvement which comprises:

(1) filling the top horizontal spacer bar with a solid adsorbent having average pore diameters which permit the entry of benzene into the pore space and providing openings in the planar surface of said bar facing said enclosed air space, and (2) employing as at least one of the vertical spacer bars a spacer bar filled with a solid adsorbent capable of adsorbing water vapor, said at least one spacer bar being provided with openings at one end in the planar surface facing the enclosed air space and having a small opening in the other planar surface facing toward the atmosphere, said small opening being so placed that the openings in the two planar surfaces are at opposite ends of the spacer bar whereby water vapor is adsorbed when the temperature in the enclosed space drops and air from the ambient atmosphere flows through the solid adsorent into the enclosed space, and water vapor is desorbed when air in the enclosed space is heated and the heated air from the enclosed space flows through the solid adsorbent into the atmosphere.

5. A double glazed window as defined in claim 4 wherein the vertical spacer bar is filled with an adsorbent which is predominantly 3 Å molecular sieve zeolite.

* * * * *